US006714208B1

(12) United States Patent
Yamaguchi

(10) Patent No.: US 6,714,208 B1
(45) Date of Patent: Mar. 30, 2004

(54) METHOD OF DISPLAYING MONOCHROMATIC IMAGE ON COLOR MONITOR AND IMAGE DISPLAY APPARATUS FOR IMPLEMENTING THE METHOD

(75) Inventor: Akira Yamaguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/576,267

(22) Filed: May 24, 2000

(30) Foreign Application Priority Data

May 24, 1999 (JP) ..... 11-143066

(51) Int. Cl.[7] ..... G09G 5/02

(52) U.S. Cl. ..... 345/600; 345/589; 345/596; 345/597; 345/593; 345/605; 348/694; 348/34

(58) Field of Search ..... 345/589, 596, 345/597, 593, 694, 600, 605; 348/34

(56) References Cited

U.S. PATENT DOCUMENTS 4,998,165 A * 3/1991 Lindstrom ..... 348/34
5,375,193 A * 12/1994 Adams, Jr. ..... 345/603
5,491,496 A * 2/1996 Tomiyasu ..... 345/690
5,900,886 A * 5/1999 Shay ..... 345/520
6,028,646 A * 2/2000 Jeong et al. ..... 348/645
6,108,441 A * 8/2000 Hiratsuka et al. ..... 382/167
6,177,914 B1 * 1/2001 Iwama et al. ..... 345/60
6,239,776 B1 * 5/2001 Havel ..... 345/83
6,313,816 B1 * 11/2001 Kojima et al. ..... 345/690
6,535,186 B1 * 3/2003 Havel ..... 345/83

* cited by examiner

*Primary Examiner*—Matthew C. Bella
*Assistant Examiner*—Mike Rahmjoo
(74) *Attorney, Agent, or Firm*—Sughrue Mion, PLLC

(57) ABSTRACT

The method of displaying a monochromatic image on a color monitor and the image display apparatus display the monochromatic image on a color display device with red, green and blue cells as a unit pixel. In the method and apparatus, all density regions of the monochromatic image to be displayed are provided with bluish tints. The image data for the monochromatic image is output for display after it is allotted to red, green and blue data to satisfy following relationships:

$$R\ \text{data}=k_R \cdot B\ \text{data}(0<k_R<1)$$

$$G\ \text{data}=k_G \cdot B\ \text{data}(0<k_G<1),$$

where symbols R, G and B denote red, green and blue, respectively and symbols $k_R$ and $k_G$ denote allotment ratios for R and G data to B data, respectively. By the method and the apparatus, the so-called "blue based" monochromatic films used in the medical field can be displayed in a format (characteristics) suitable for diagnostic purposes.

13 Claims, 4 Drawing Sheets

METHOD OF DISPLAYING MONOCHROMATIC IMAGE ON COLOR MONITOR AND IMAGE DISPLAY APPARATUS FOR IMPLEMENTING THE METHOD

BACKGROUND OF THE INVENTION

This invention relates to a method of displaying monochromatic image on a color image display apparatus such as a color monitor and an image display apparatus for implementing the method. More specifically, the invention relates to a method by which the so-called "blue based" monochromatic films used in the medical field can be displayed in a format (characteristics) suitable for diagnostic purposes. The invention also relates to an image display apparatus for implementing the method.

The diagnostic images taken with medical diagnostic apparatus such as X-ray diagnostic apparatus, MRI (magnetic resonance imaging) apparatus and various types of CT (computed tomographic) apparatus are usually recorded on light-transmitting image recording films such as X-ray films and light-sensitive materials in film form and thereafter reproduced as light-transmissive images. The films showing the reproduced diagnostic images are set on a viewing device called a light fox ("Schaukasten") or a film viewer and illuminated with backlight so that the images are viewed for diagnosis.

Conventionally, apparatus for medical diagnosis and instrumentation have a CRT (cathode-ray tube) display or LCD (liquid-crystal display) connected as a monitor for viewing the images taken and measured with such apparatus. Diagnosis is performed on the basis of the image output to the monitor or the diagnostic images yet to be output on films are checked, adjusted or otherwise processed on the monitor.

The images taken with the medical diagnostic apparatus or those taken and measured with the apparatus for medical diagnosis and instrumentation are often reproduced on so-called "blue based" monochromatic films. The gradation resolution of the reproduced images is typically in 10 bits (providing 1024 gradations).

Two problems are posed here. The first problem is associated with the fact that blue-based monochromatic films are used for image reproduction whereas the monitor screen is white-based. The doctor has to examine both types of images but due to limitations of the human visual sense, it is not easy to switch from one type of image to the other by intuition. To a doctor who has become accustomed to looking at one type of image, the other type is felt difficult to see.

The second problem concerns the fact that CRTs usually display images at a gradation resolution of 8 bits and LCDs usually display images at a gradation resolution of 6 bits, sometimes in 8 bits if they are of the latest high-performance model. Thus, whichever of the monitors in current use display images with image data having a lower gradation resolution than the image data that has been output after image taking and measurement with the apparatus for medical diagnosis and instrumentation, that is to say, so-called "image data that cancellation of significant bits has occurred".

Therefore, this "cancellation of significant bits of the image data" occasionally causes a kind of noise called "artefacts" in contour lines which are commonly called pseudo-contours. Such noise will reduce or spoil the reliability of diagnoses and must be eliminated from medical diagnostic images.

To deal with this second problem, it has been proposed to use frame rate control (FRC) display. In this technique, 10-bit image data may be divided by four to give four frames of 8-bit image data which are displayed consecutively to represent a 10-bit gradation in 8 bits. However, this approach suffers from the problem of flicker in the image for the very reason that FRC is performed.

In order to eliminate flicker, the frame frequency in FRC display has to be increased to permit high enough display switching. In practice, however, the driver IC for the monitor and the monitor itself are limited in response speed. This problem presents considerable difficulty in medical diagnostic applications where an increased number of pixels are used with a view to providing higher image quality by representation of a high-definition image such as QSXGA (2560×2048 pixels).

SUMMARY OF THE INVENTION

The present invention has been accomplished under these circumstances and has as an object providing a method of displaying a monochromatic image on a color monitor, by which the so-called "blue based" monochromatic films used in the medical field can be displayed in a format (characteristics) suitable for diagnostic purposes.

Another object of the invention is to provide an image display apparatus that is suitable for implementing the method.

In order to attain the object described above, the present invention provides a method of displaying a monochromatic image on a color monitor, comprising the steps of: displaying the monochromatic image on a color display device with red, green and blue cells as a unit pixel, wherein all density regions of the monochromatic image to be displayed are provided with bluish tints.

In the method of displaying the monochromatic image on the color monitor of the present invention, a higher luminance area of the monochromatic image to be displayed is preferably provided with the more bluish tint.

In the method of the present invention, image data for the monochromatic image is preferably output for display after it is allotted to red, green and blue data to satisfy following relationships:

$$R\ \text{data}=k_R \cdot B\ \text{data}(0<k_R<1)$$

$$G\ \text{data}=k_G \cdot B\ \text{data}(0<k_G<1),$$

where symbols R, G and B denote red, green and blue, respectively and symbols $k_R$ and $k_G$ denote allotment ratios for R and G data to B data, respectively.

In the method of the present invention, the above-described allotment ratios $k_R$ and $k_G$ may particularly satisfy a following relationship: $k_R=k_G=k$ $(0<k<1)$, where symbols k denotes an allotment ratio to B data.

Namely, if R data≈ G data<B data, the monochromatic image to be displayed can be provided with the bluish tints or blue shades over all density regions.

In the method of the present invention, a color space for a color to be represented that has been allotted to the R, G and B data is preferably represented by coordinates (x,y) on a CIE chromaticity diagram and located within a region bounded by coordinates (0.174, 0.0), (0.4, 0.4) and ($\alpha$, 0.4), where $\alpha$ is an x-coordinate of a point at which a spectrum locus crosses a straight line that is parallel to an x-axis and which intercepts a y-axis at 0.4.

In the method of the present invention, each of the allotted R, G and B data is subdivided into data for a plurality of frame-rate-control frames by a mask rounding dispersion treatment and the R, G and B data are independently driven by frame-rate-control using the data subdivided to the individual frames.

In the method of the present invention, a liquid-crystal panel is used as the color display device.

The present invention can be actualized as an image display apparatus implementing the method descried above.

That is to say, the present invention can be actualized as an image display apparatus, comprising a color display device using red, green and blue cells as a unit pixel and a data allotting unit by which image data for a monochromatic image to be displayed on the color display device is output for display after it is allotted to red, green and blue data to satisfy following relationships:

$$R\ \text{data}=k_R \cdot B\ \text{data}(0<k_R<1)$$

$$G\ \text{data}=k_G \cdot B\ \text{data}(0<k_G<1),$$

where symbols R ,G and B denote red, green and blue, respectively and symbols $k_R$ and $k_G$ denote allotment ratios for R and G data to B data, respectively, wherein the image data for the monochromatic image allotted by the data allotting unit is output as the R, G and B data for display on the color display device.

In the image display apparatus of the present invention, the above-described allotment ratios $k_R$ and $k_G$ may particularly satisfy a following relationship:

$$k_R=k_G=k(0<k<1).$$

The R, G and B data may satisfy a following relationship:

$$R\ \text{data} \cdot G\ \text{data}<B\ \text{data}.$$

In the image display apparatus of the present invention, the data allotting unit allots the data in such a way that a color space for a color that has been allotted to the R, G and B data is represented by coordinates (x,y) on a CIE chromaticity diagram and located within a region bounded by coordinates (0.174, 0.0), (0.4, 0.4) and ($\alpha$, 0.4), where $\alpha$ is an x-coordinate of a point at which a spectrum locus crosses a straight line that is parallel to an x-axis and which intercepts a y-axis at 0.4.

It is preferable that the image display apparatus of the present invention further comprises a drive processing unit by which each of the allotted R, G and B data is subdivided into data for a plurality of frame-rate-control frames by a mask rounding dispersion treatment and the R, G and B data are independently driven by frame-rate-control using the data subdivided to the individual frames.

In the image display apparatus of the present invention, a liquid-crystal panel is used as the color display device.

DETAILED DESCRIPTION OF THE INVENTION

On the pages that follow, the image display method and apparatus of the present invention for displaying the monochromatic image on the color monitor are described in detail with reference to the preferred embodiments shown in the accompanying drawings.

Figure 1:
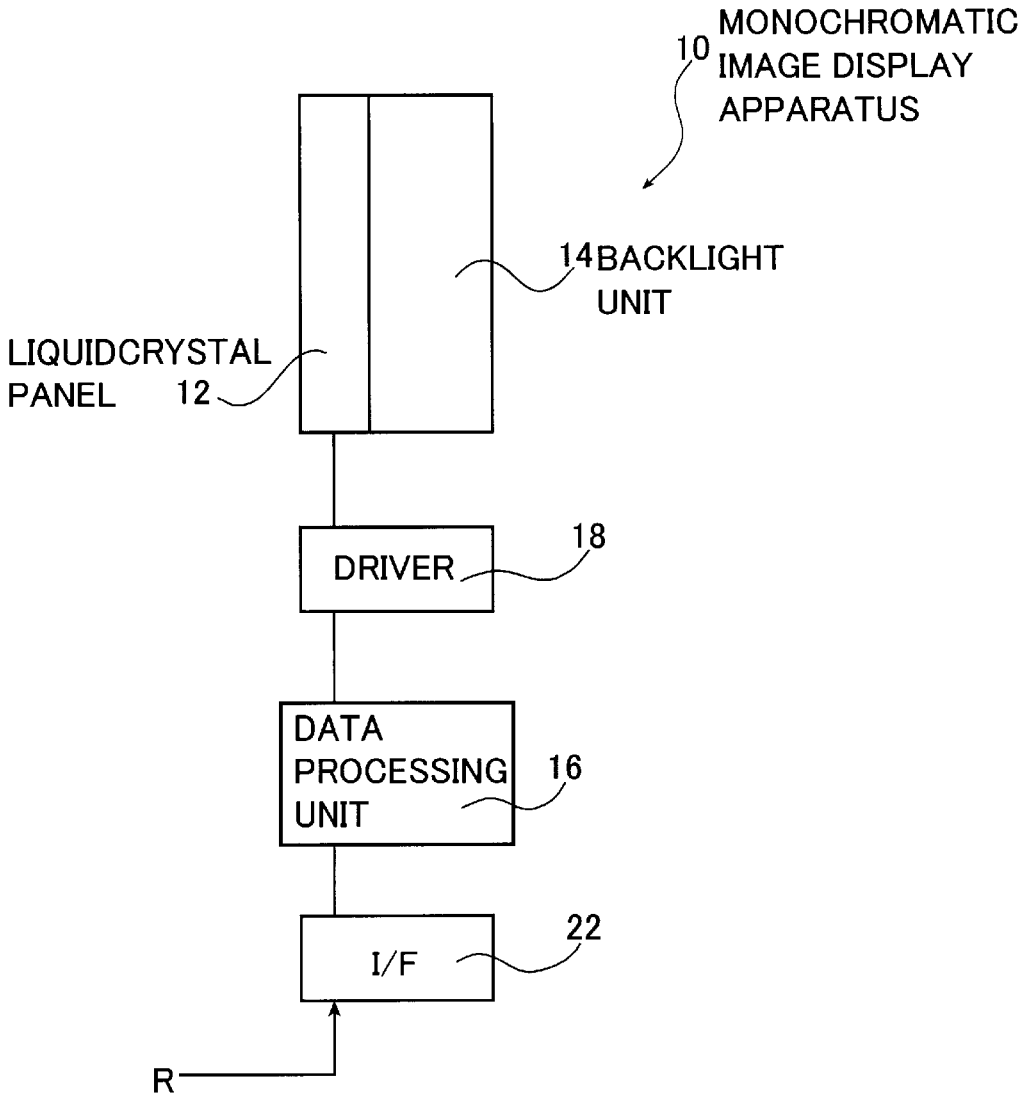
FIG. 1 shows in conceptual form an embodiment of the invention in which the claimed image display apparatus is used as a monitor for a medical diagnostic apparatus.

FIG. 1 shows in conceptual form an embodiment of the invention in which the claimed image display apparatus is used as a monitor for a medical diagnostic apparatus. The image display apparatus generally indicated by 10 in FIG. 1 is a liquid-crystal display (LCD) and comprises a liquid-crystal panel 12 that displays images by liquid crystal, a backlight unit 14, a data processing unit 16 which performs data processing in the manner to be described later, a driver 18 of the liquid-crystal panel 12, and an interface (I/F) 22.

The illustrated image display apparatus 10 is connected via the interface 22 to the image shooting section (hereunder referred to as R) of medical diagnostic apparatus such as an X-ray diagnostic apparatus, an MRI diagnostic apparatus and various types of CT apparatus that are sources of diagnostic images to be displayed and from which image data are supplied to the image display apparatus 10.

In the LCD that can be used in the image display apparatus of the invention, the liquid-crystal panel 12 is not limited to any particular type and all known liquid-crystal panels that are used in various kinds of LCDs may be employed. The liquid-crystal panel 12 can be operated in all known modes including a TN (twisted nematic) mode, a STN (supertwisted nematic) mode and a MVA (multi-domain vertical alignment) mode.

The backlight unit 14 issues backlight for viewing the image displayed on the liquid-crystal panel 12 and may have the same construction as the backlight mechanism in known LCDs. It should be noted that the image display apparatus 10 preferably has the ability to provide a display at a maximum luminance (brightness) of 500 cd/m$^2$–5,000 cd/m$^2$ so that it can advantageously be used as a monitor in medical applications.

As will be described below in detail, the data processing unit 16 functions as the data allotting unit that is a characteristic part of the present invention and that allots the image data for the monochromatic image to be displayed on the liquid-crystal panel 12 to R (red), G (green) and B (blue) data, outputs the thus allotted R, G and B data for display to the driver 18 of the liquid-crystal panel 12. The data processing unit 16 further has the function such that for performing FRC display, the image data, for example, the 10-bit image data supplied from the image shooting section R is converted to the image data suitable for image display by the image display apparatus 10, for example, 8 bit image data and then supplied to the driver 18 of the liquid-crystal panel 12. In the description that follows hereinafter, the image data supplied from the image shooting section R is typically described as the 10-bit image data and the image data suitable for the image display is typically described as the 8-bit image data or the 10-bit image data. However, the present invention is by no means limited this sole case.

Figure 2:
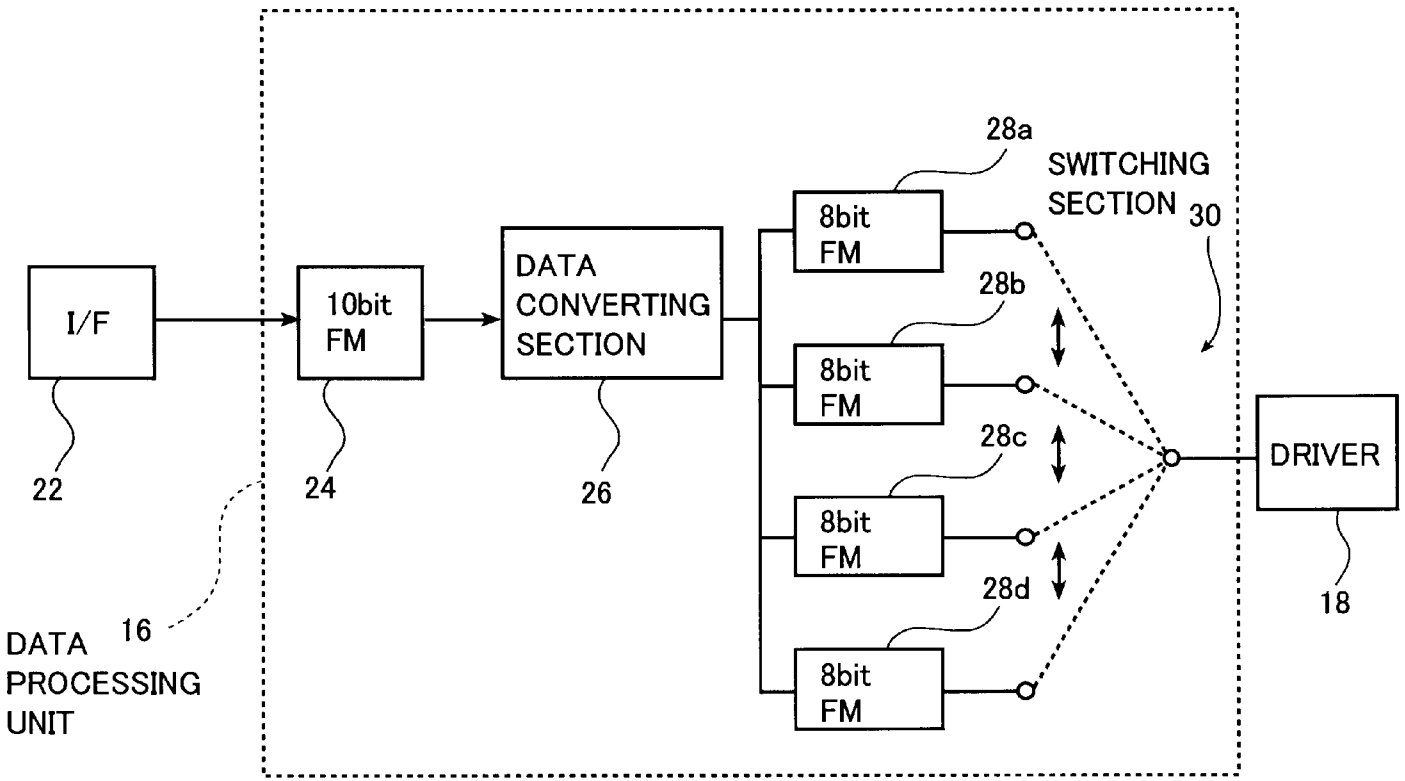
FIG. 2 is a block diagram for an embodiment of the data processing unit of the image display apparatus shown in FIG. 1.

FIG. 2 is a block diagram of an embodiment of the data processing unit 16. As shown, the data processing unit 16 comprises a frame memory 24 for storing the 10 bit image data, a data converting section 26, frame memories 28*a*, 28*b*, 28*c* and 28*d* for storing the 8-bit image data, and a switching section 30. The function of the switching section 30 is such that the 8-bit image data stored in the frame memories 28*a*, 28*b*, 28*c* and 28*d* are sequentially output for FRC display.

In this data processing section 16, the 10-bit image data supplied from the interface 22 is stored in the frame memory 24 and subsequently read into the data converting section 26, where it is converted to 8-bit image data.

Having this construction, the image display apparatus 10 in the embodiment under consideration can be operated in various ways.

In one example, suppose that the image shooting section R supplies image data at a gradation resolution of 10 bits whereas the image display apparatus 10 of the embodiment under consideration displays image at a gradation resolution of 8 bits. In this first example, the data processing unit 16 allots the initial data (monochromatic image data) consisting of 1024 pieces (0–1023) according to the following equations:

$$B \text{ data} = \text{initial data}/4 \text{ (discard decimal fractions)}$$

$$R \text{ data} = G \text{ data} = 0.9 \times B \text{ data (discard decimal fractions)}$$

For details of this allotment, see Table 1 below.

TABLE 1

<Allotting to R, G and B data>

| Initial data | R data | G data | B data |
|---|---|---|---|
| 0 | 0 | 0 | 0 |
| 1 | 0 | 0 | 0 |
| 2 | 0 | 0 | 0 |
| 3 | 0 | 0 | 0 |
| 4 | 0 | 0 | 1 |
| 5 | 0 | 0 | 1 |
| 6 | 0 | 0 | 1 |
| 7 | 0 | 0 | 1 |
| 8 | 1 | 1 | 2 |
| 9 | 1 | 1 | 2 |
| 10 | 1 | 1 | 2 |
| 11 | 1 | 1 | 2 |
| 12 | 2 | 2 | 3 |
| . | . | . | . |
| . | . | . | . |
| . | . | . | . |
| 509 | 114 | 114 | 127 |
| 510 | 114 | 114 | 127 |
| 511 | 114 | 114 | 127 |
| 512 | 115 | 115 | 128 |
| . | . | . | . |
| . | . | . | . |
| . | . | . | . |
| 1019 | 228 | 228 | 254 |
| 1020 | 229 | 229 | 255 |
| 1021 | 229 | 229 | 255 |
| 1022 | 229 | 229 | 255 |
| 1023 | 229 | 229 | 255 |

Obviously, after allotment by the above equations, B data has somewhat larger values than R and G data in the low-brightness area of the initial data but the differences between B data, and R and G data increase with increasing brightness.

If the thus allotted image data is supplied from the data processing unit 16 into the driver 18 of the liquid-crystal panel 12, the image display apparatus 10 of the embodiment under consideration can display a monochromatic image with its bluish tint (blue hue) varying with the density of the image. If the same image is reproduced on a blue-based film, the low-density area (corresponding to the high-brightness area of the monitored image) has a more bluish tint or an intense blue shade whereas the high-density area (corresponding to the low-brightness area of the monitored image) has a less bluish tint or a weak blue shade and this allows the reproduced image to be viewed without suffering a drop in visual contrast.

In the first example, the image data supplied from the image shooting section R which has a gradation resolution of 10 bits is processed by the image display apparatus 10 to permit image display at a gradation resolution of 8 bits. We next describe a second example in which the aforementioned capability of FRC display is utilized to ensure that the image data supplied from the image shooting section R which has a gradation resolution of 10 bits is processed by the image display apparatus 10 to permit image display as if the gradation resolution is the same (10 bits).

To this end, the initial 10-bit image data is displayed as an image consisting of 4 frames of 8-bit image data. The following is supplemental information about FRC display.

As is well known, FRC display is a technique for allowing image data of high bit number (high gradation resolution) to be displayed with image data of a lower bit number; to this end, the high-bit image data is processed to generate frames of lower-bit image data whose number depends on the difference in bit number, and the generated frames are successively displayed so that the lower-bit image display provides a gradation representation equivalent to the high bit number.

Specifically, if the difference in bit number is written as n, $2^n$ frames of image data with the lower bit number are generated and sequentially displayed. In this way, 4 frames of image data having a gradation resolution of 8 bits may be used to provide gradation representation equivalent to 10 bits (n=2), thereby enabling the display of an image which is very bright and yet does not have any artefacts.

Generally speaking, FRC display is an effective way to prevent artefacts but unless the frames in the subdivided image data are switched rapidly enough, namely, if the frame frequency is not high enough, flicker occurs in the displayed image.

This is not the case with the present invention. In accordance with the proportion of identical image data contained in a specified region, namely, the proportion of a specified area that is occupied by a given density, the method of subdividing (further allotting) image data to be subjected to FRC display is suitably altered, thereby preventing the occurrence of flickers to enable the representation of a flickerless, high-contrast image without the need to increase the frame frequency.

As already mentioned, a display of 10-bit image can be represented by 4 frames of 8-bit image in FRC display.

The "initial data" represented in Table 1 may be allotted as shown in Tables 2 and 3 below so that it is represented in 10 bits by 4 frames of 8-bit image data in FRC display.

TABLE 2

<Allotting to R, G and B data>

| Initial data | R data | G data | B data |
|---|---|---|---|
| 0 | 0 | 0 | 0 |
| 1 | 0 | 0 | 1 |
| 2 | 1 | 1 | 2 |
| 3 | 2 | 2 | 3 |
| 4 | 3 | 3 | 4 |
| 5 | 4 | 4 | 5 |
| 6 | 5 | 5 | 6 |

TABLE 2-continued

<Allotting to R, G and B data>

| Initial data | R data | G data | B data |
|---|---|---|---|
| 7 | 6 | 6 | 7 |
| 8 | 7 | 7 | 8 |
| 9 | 8 | 8 | 9 |
| 10 | 9 | 9 | 10 |
| 11 | 9 | 9 | 11 |
| 12 | 10 | 10 | 12 |
| . | . | . | . |
| . | . | . | . |
| . | . | . | . |
| 509 | 458 | 458 | 509 |
| 510 | 459 | 459 | 510 |
| 511 | 459 | 459 | 511 |
| 512 | 460 | 460 | 512 |
| . | . | . | . |
| . | . | . | . |
| . | . | . | . |
| 1021 | 918 | 918 | 1021 |
| 1022 | 919 | 919 | 1022 |
| 1023 | 920 | 920 | 1023 |

TABLE 3

<Allotting to frame data>

| Each of R, G and | Frame data (without rounding) | | | | Frame data (with rounding) | | | |
|---|---|---|---|---|---|---|---|---|
| B Data | #1 | #2 | #3 | #4 | #1 | #2 | #3 | #4 |
| 0 | 0 | 0 | 0 | 0 | 0 | 0 | 0 | 0 |
| 1 | 1 | 0 | 0 | 0 | 0 | 0 | 0 | 0 |
| 2 | 1 | 0 | 1 | 0 | 0 | 0 | 0 | 0 |
| 3 | 1 | 1 | 1 | 0 | 0 | 0 | 0 | 0 |
| 4 | 1 | 1 | 1 | 1 | 1 | 1 | 1 | 1 |
| 5 | 2 | 1 | 1 | 1 | 1 | 1 | 1 | 1 |
| 6 | 2 | 1 | 2 | 1 | 1 | 1 | 1 | 1 |
| 7 | 2 | 2 | 2 | 1 | 1 | 1 | 1 | 1 |
| 8 | 2 | 2 | 2 | 2 | 2 | 2 | 2 | 2 |
| 9 | 3 | 2 | 2 | 2 | 2 | 2 | 2 | 2 |
| 10 | 3 | 2 | 3 | 2 | 2 | 2 | 2 | 2 |
| 11 | 3 | 3 | 3 | 2 | 2 | 2 | 2 | 2 |
| 12 | 3 | 3 | 3 | 3 | 3 | 3 | 3 | 3 |
| . | . | . | . | . | . | . | . | . |
| . | . | . | . | . | . | . | . | . |
| . | . | . | . | . | . | . | . | . |
| 508 | 127 | 127 | 127 | 127 | 127 | 127 | 127 | 127 |
| 509 | 128 | 127 | 127 | 127 | 127 | 127 | 127 | 127 |
| 510 | 128 | 127 | 128 | 127 | 127 | 127 | 127 | 127 |
| 511 | 128 | 128 | 128 | 127 | 127 | 127 | 127 | 127 |
| 512 | 128 | 128 | 128 | 128 | 128 | 128 | 128 | 128 |
| . | . | . | . | . | . | . | . | . |
| . | . | . | . | . | . | . | . | . |
| . | . | . | . | . | . | . | . | . |
| 1019 | 255 | 255 | 255 | 254 | 254 | 254 | 254 | 254 |
| 1020 | 255 | 255 | 255 | 255 | 255 | 255 | 255 | 255 |
| 1021 | 255 | 255 | 255 | 255 | 255 | 255 | 255 | 255 |
| 1022 | 255 | 255 | 255 | 255 | 255 | 255 | 255 | 255 |
| 1023 | 255 | 255 | 255 | 255 | 255 | 255 | 255 | 255 |

The initial data shown in Table 2 which consists of 1024 pieces (0–1023) is allotted according to the following equations:

$$B \text{ data} = \text{initial data}$$

$$R \text{ data} = G \text{ data} = 0.9 \times B \text{ data (discard decimal fractions)}$$

Obviously, the method of allotment is the same as in the previous example and B data has somewhat larger values than R and G data in the low-brightness area of the initial data but the differences between B data, and R and G data increase with increasing brightness.

In Table 3, each of the R, G and B data allotted as shown in Table 2 is subdivided or further allotted into data for a plurality of FRC frames by the following mask rounding dispersion treatment.

Figure 3:
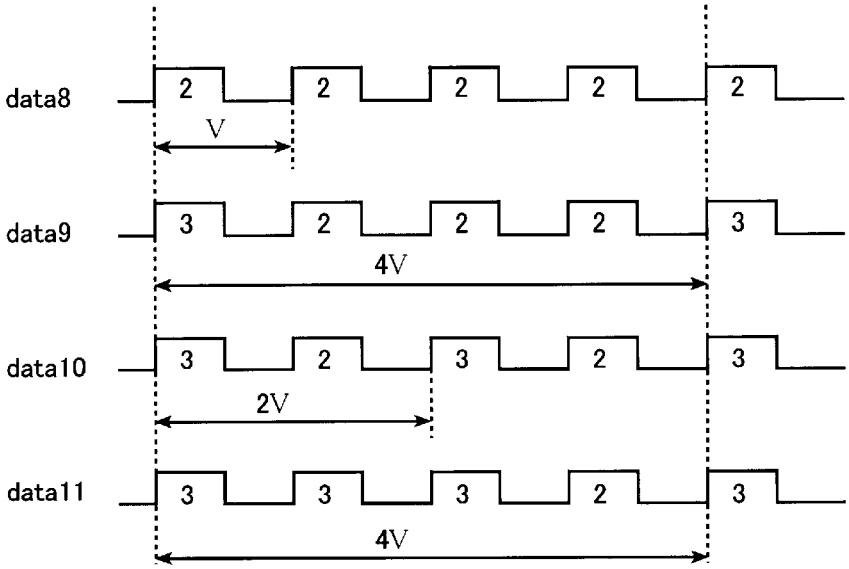
FIG. 3 is a timing chart for illustrating an example of image processing in the invention.

As already mentioned, a display of 10-bit image can be represented by 4 frames of 8-bit image data in FRC display. According to the timing chart in FIG. 3, 10-bit image data "8" is expressed by 8-bit image data in 4 frames consisting of 2, 2, 2 and 3. Similarly, 10-bit image data "9" is expressed by image data consisting of 3, 2, 2 and 2; 10-bit image data "10" by image data consisting of 3, 2, 3 and 2; and image data "11" by image data consisting of 3, 3, 3 and 2.

In the display of black-and-white images having a comparatively high brightness as exemplified by medical diagnostic images, visible flicker occurs if the discernible period is less than 60 Hz. Suppose here that FIG. 3 refers to a still image having a frame frequency of 60 Hz. With image data "8", the discernible period is 60 Hz at 1 volt and no visible flicker occurs. With image data "9", the discernible period is 15 Hz at 4 volts; with image data "10", the discernible period is 30 Hz at 2 volts; with image data "11", the discernible period is 15 Hz at 4 volts. In each of these cases, flicker is visible.

According to the study of the inventors, flicker is easy to recognize in a region of constant QL value, or a region of a measurable area having constant image data (to produce a so-called "solid image"), but in a region where various QL values occur simultaneously in small areas, namely, in the case where various kinds of image data coexist, flickers cancel each other to become no longer visible. Speaking of a medical diagnostic image, the region that is necessary for diagnosis contains various density levels in small areas and in this region, no flicker is visible even if the discernible period is less than 60 Hz.

That is the operating theory of the third example under consideration. In the data converting section 26, the proportion of identical image data within a specified region is checked and if it is equal to or greater than a specified threshold, the image data is converted to a multiple of the number of frames in FRC display (in the case shown in FIG. 2, the number of frames is 4) and thereafter converted to image data for FRC display; in other cases (the proportion of identical image data is less than the specified threshold), the image data is converted to image data for FRC display in the usual manner.

To state simply, those areas of the image which have a high proportion of identical image data typically result when X-rays passed unimpeded; since these areas have no bearing on diagnosis, they are displayed without being rendered to have a higher contrast. On the other hand, those portions of the image which contain image data of various densities in small areas are important and necessary for diagnosis; therefore, they are displayed in an increased contrast.

Figure 4:
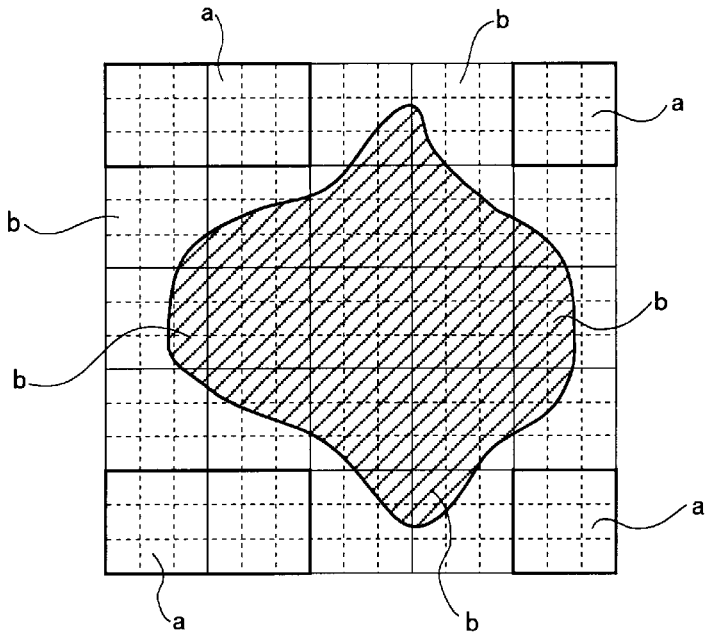
FIG. 4 illustrates how image processing is done in an example of the invention.

This point is further discussed below with reference to FIG. 4. The image shown in FIG. 4 consists of 15×15 (=255) pixels each being marked by dashed lines; the hatched region is an actual (meaningful) image containing various kinds of image data; the other regions compose the background and represent identical image data.

The data converting section 26 reads image data from the frame memory 24, divides the image into 25 regions using masks as indicated by solid lines that each consist of 3×3 pixels, detects the proportion of identical image data within each region and determines if it is equal to or greater than a threshold. If the threshold is the total number of pixels (100% pixels), it is within the regions a indicated by thick lines that all images represent identical image data.

If the image data read from the frame memory 24 is for the regions (masks) b where the proportion occupied by identical image data is less than the threshold, the data converting section 26 generates image data of lower gradation resolution by performing FRC display in the usual manner. In the case under discussion, 10-bit image data is converted to 8-bit data for FRC display. If the 10-bit image data supplied from the image shooting section R via the interface 22 is "511", it is converted to 8-bit image data in 4 frames consisting of 128, 128, 128 and 127. Therefore, in the region containing the actual image, the correct image having no visible flicker is represented by the appropriate image data.

If the image data read from the frame memory 24 is for the regions a bounded by thick lines where the proportion of identical image data is equal to or greater than the threshold, the data converting section 26 converts the image data to a multiple of the number of frames in FRC and thereafter converts the resulting image to image data for FRC display.

Suppose again that 10-bit image data "511" has been supplied from the image shooting section R via the interface 22. The image data is first converted to a multiple of the frame number 4, say, 10-bit image data "512", which is then converted to 8-bit data in 4 frames consisting of 128, 128, 128 and 128. Similarly, if the supplied 10-bit image data is "258", it is first converted to 10-bit image data "256", which is then converted to 8-bit data in 4 frames consisting of 64, 64, 64 and 64.

Thus, all frames are rendered to represent identical image data so that there will be no decrease in the discernible period that results from FRC display, thereby preventing the occurrence of flicker.

In the previous example, the image as reproduced on a blue-based film comes out with more bluish tints or intense i blue shades in the low-density area but comes out with more bluish tints or weak blue shades in the high-density area; in addition, those areas of the image which have no bearing on diagnosis are displayed without being rendered to have a higher contrast whereas those portions which are important and necessary for diagnosis are displayed in an increased contrast.

The foregoing examples are for illustrative purposes only and are by no means intended to limit the scope of the present invention. For instance, the area of the specified region for detecting the proportion of identical image data, which is the mask size in the case shown in FIG. 4, is not limited in any particular way and may be determined as appropriate for the size of a pixel.

The threshold for detecting the proportion of identical image data depending on which the supplied image data is converted to a multiple of the frame number is not limited in any particular way, either, and may be determined as appropriate for brightness, frame frequency, pixel size and other factors.

The present invention is by no means limited to the case of converting 10-bit image data to 8-bit data for FRC display.

Figure 5:
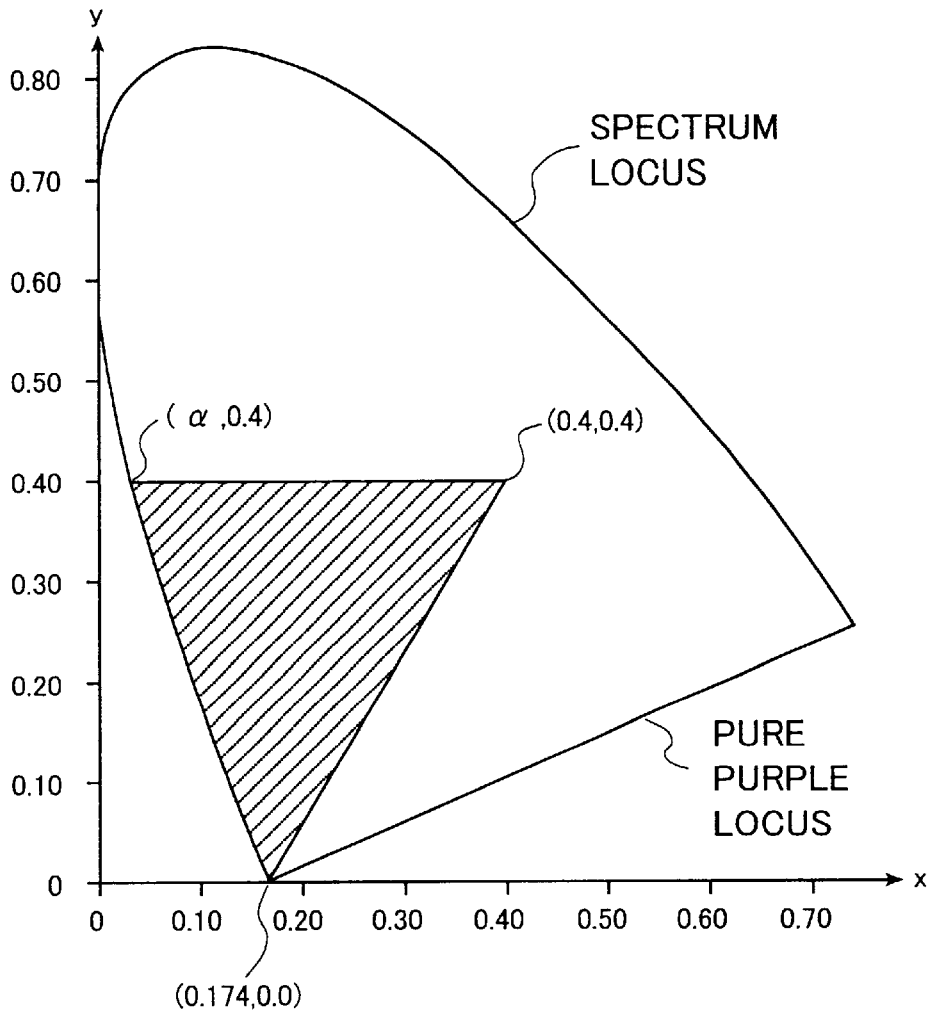
FIG. 5 is a diagram showing an example of a preferred region of the chromaticity in which the image on a blue-based monochromatic film is to be reproduced by image processing in an embodiment of the invention.

Further referring to the allotment to R, G and B image data, the chromaticity of the image represented as the result of allotment is preferably within the hatched triangular region of the chromaticity diagram shown in FIG. 5 which is bounded by coordinates (0.174, 0.0), (0.4, 0.4) and ($\alpha$, 0.4) (where $\alpha$ is the x-coordinate of the point at which the spectrum locus crosses a straight line that is parallel to the x-axis and which intercepts the y-axis at 0.4).

In the embodiment described above, the liquid-crystal panel 12 is used as the color image display device. However, the color image display device used in the present invention is not limited to this sole case and any kind of the color image display device may be used so long as it is constituted with R, G and B cells as a unit pixel.

As described above in detail, the present invention ensures that the "blue based" monochromatic films used in the medical field can be displayed in a format (characteristics) suitable for diagnostic purposes. The invention also provides an image display apparatus that can advantageously be used in making such display.

What is claimed is:

1. A method of displaying a monochromatic image on a color monitor, comprising the steps of:

displaying the monochromatic image on a color display device with red, green and blue cells as a unit pixel, wherein all density regions of the monochromatic image to be displayed are provided with bluish tints.

2. The method according to claim 1, wherein a higher luminance area of the monochromatic image to be displayed is provided with the more bluish tint.

3. The method according to claim 1, wherein image data for said monochromatic image is output for display after it is allotted to red, green and blue data to satisfy following relationships:

$$R\ \text{data}=k_R \cdot B\ \text{data}(0<k_R<1)$$

$$G\ \text{data}=k_G \cdot B\ \text{data}(0<k_G<1),$$

where symbols R, G and B denote red, green and blue, respectively and symbols $k_R$ and $k_G$ denote allotment ratios for R and G data to B data, respectively.

4. The method according to claim 3, wherein said allotment ratios $k_R$ and $k_G$ satisfy a following relationship:

$$k_R=k_G=k(0<k<1)$$

where symbols k denotes an allotment ratio to B data.

5. The method according to claim 3, wherein a color space for a color to be represented that has been allotted to said R, G and B data is represented by coordinates (x,y) on a CIE chromaticity diagram and located within a region bounded by coordinates (0.174, 0.0), (0.4, 0.4) and ($\alpha$, 0.4), where $\alpha$ is an x-coordinate of a point at which a spectrum locus crosses a straight line that is parallel to an x-axis and which intercepts a y-axis at 0.4.

6. The method according to claim 3, wherein each of said allotted R, G and B data is subdivided into data for a plurality of frame-rate-control frames by a mask rounding dispersion treatment and said R, G and B data are independently driven by frame-rate-control using the data subdivided to said individual frames.

7. The method according to claim 1, wherein a liquid-crystal panel is used as said color display device.

8. An image display apparatus, comprising:

a color display device using red, green and blue cells as a unit pixel; and a data allotting unit by which image data for a monochromatic image to be displayed on said color display device is output for display after it is allotted to red, green and blue data to satisfy following relationships:

$$R\ \text{data}=k_R \cdot B\ \text{data}(0<k_R<1)$$

$$G\ \text{data}=k_G \cdot B\ \text{data}(0<k_G<1),$$

where symbols R ,G and B denote red, green and blue, respectively and symbols $k_R$ and $k_G$ denote allotment ratios for R and G data to B data, respectively, wherein the image data for the monochromatic image allotted by said data allotting unit is output as said R, G and B data for display on said color display device.

9. The image display apparatus according to claim 8, wherein said allotment ratios $k_R$ and $k_G$ satisfy a following relationship:

$$k_R=k_G=k(0<k<1).$$

10. The image display apparatus according to claim 8, wherein said data allotting unit allots said data in such a way that a color space for a color that has been allotted to said R, G and B data is represented by coordinates (x,y) on a CIE chromaticity diagram and located within a region bounded by coordinates (0.174, 0.0), (0.4, 0.4) and ($\alpha$, 0.4), where $\alpha$ is an x-coordinate of a point at which a spectrum locus crosses a straight line that is parallel to an x-axis and which intercepts a y-axis at 0.4.

11. The image display apparatus according to claim 8, further comprising:

a drive processing unit by which each of said allotted R, G and B data is subdivided into data for a plurality of frame-rate-control frames by a mask rounding dispersion treatment and said R, G and B data are independently driven by frame-rate-control using the data subdivided to said individual frames.

12. The image display apparatus according to claim 8, wherein a liquid-crystal panel is used as said color display device.

13. The method according to claim 1, wherein each of said R, G and B data is subdivided into data for a plurality of frame-rate-control frames by a mask rounding dispersion treatment and said R, G and B data are independently driven by frame-rate-control using the data subdivided into individual frames.

* * * * *